US005487229A

United States Patent [19]

Nathenson et al.

[11] Patent Number: 5,487,229

[45] Date of Patent: Jan. 30, 1996

[54] APPARATUS FOR PNEUMATIC EXCAVATION

[75] Inventors: Richard D. Nathenson; Jerome Apt, Jr.; Martin J. Uram, all of Pittsburgh; Paul M. Brumbaugh, North Versailles, all of Pa.; Gary H. Brawley, Columbus, Ohio; Donald J. Hackman, Upper Arlington, Ohio; Brian Christenson, Columbus, Ohio

[73] Assignee: Electric Power Research Institute, Inc., Palo Alto, Calif.

[21] Appl. No.: 68,920

[22] Filed: May 28, 1993

[51] Int. Cl.[6] ..... E02F 5/02

[52] U.S. Cl. ..... 37/347; 406/171; 406/81; 406/82; 175/67; 37/323

[58] Field of Search ..... 37/347, 905, 317, 37/189, 190, 323, 335; 299/9, 17; 175/67; 406/173, 171, 115, 106, 116, 152, 81, 82; 285/261

[56] References Cited

U.S. PATENT DOCUMENTS

| | | | |
|---|---|---|---|
| 3,794,388 | 2/1974 | Westenberg | 406/116 |
| 3,930,324 | 1/1976 | Wightman et al. | 37/189 |
| 3,995,889 | 12/1976 | Carr et al. | 285/261 |
| 4,217,001 | 8/1980 | Youngers et al. | 299/82 |
| 4,436,457 | 3/1984 | Willingham | 406/116 |
| 4,585,274 | 4/1986 | Grable | 299/7 |
| 4,659,262 | 4/1987 | van Aalst | 406/115 |
| 4,667,750 | 5/1987 | Wise et al. . | |
| 4,695,205 | 9/1987 | Levine | 406/173 |
| 4,753,549 | 6/1988 | Shook et al. | 299/17 |
| 4,776,731 | 10/1988 | Briggs et al. | 406/152 |
| 4,793,734 | 12/1988 | Shook et al. | 299/17 |
| 4,848,844 | 7/1989 | Weiss | 299/55 |
| 4,850,750 | 7/1989 | Cogbill et al. | 406/82 |
| 4,919,585 | 4/1990 | Ruiz | 414/718 |
| 4,936,031 | 6/1990 | Briggs et al. | 37/347 |
| 4,973,203 | 11/1990 | Oftedal | 406/152 |
| 4,988,240 | 1/1991 | Thompson | 406/173 |
| 4,991,321 | 2/1991 | Artzberger | 37/62 |
| 5,016,717 | 5/1991 | Simons et al. | 175/66 |
| 5,092,733 | 3/1992 | Kishi | 414/718 |
| 5,120,165 | 6/1992 | Walko | 406/173 |
| 5,163,786 | 11/1992 | Christianson | 406/173 |
| 5,295,317 | 3/1994 | Perrott | 37/347 |
| 5,425,188 | 6/1995 | Rinker | 299/17 |

FOREIGN PATENT DOCUMENTS

| | | | |
|---|---|---|---|
| 4138619 | 7/1992 | Germany | 37/905 |
| 58-222223 | 12/1983 | Japan | 37/905 |
| 4-277226 | 10/1992 | Japan | 37/905 |

*Primary Examiner*—Henry E. Raduazo
*Assistant Examiner*—Spencer K. Warnick, IV
*Attorney, Agent, or Firm*—Flehr, Hohbach, Test, Albritton & Herbert

[57] ABSTRACT

An excavation head, mounted on one end of a telescoping hollow boom, has nozzles for directing jets of high speed air at an excavation face to loosen soil. A vacuum transport pipe extends from the excavation head through the hollow of the boom to a spherical joint. The spherical joint movably joins the other end of the boom to a primary separator. The primary separator is a chamber for disentraining loosened soil from air flowing through the primary separator. A primary air lock is fixed to the lower portion of the primary separator for expelling soil from the primary separator. A secondary separator is joined to the primary separator by way of a separator connector pipe. A secondary air lock is fixed to the lower portion of the secondary separator for expelling soil from the secondary separator. A positive displacement vacuum pump has its vacuum side pneumatically connected to the secondary separator. A conveyor is located under both the primary air lock and the secondary air lock to receive soil that is expelled by these air locks. Hydraulic actuators lift, swing, and extend the boom such that the excavation head is positioned on the excavation face.

23 Claims, 11 Drawing Sheets

APPARATUS FOR PNEUMATIC EXCAVATION

BACKGROUND OF THE INVENTION

1. Field of Invention

This invention relates generally to excavation and more particularly to excavation using air jets to loosen soil and to using vacuum for removing soil from an excavation face.

2. Description of the Related Art

Trench digging is a common activity for installing or gaining access to buried utilities such as electric power cables, natural gas piping, communications cables, and water pipes. The backhoe is a traditional trencher which uses an upside-down bucket mounted on a hinged boom. A trenching machine uses a series of buckets mounted on a chain or wheel to lift soil from the ground and to deposit that soil alongside the trench to be dug. The hand-wielded pick or shovel provide a relatively low capacity trenching means.

In excavation, there are two principal actions involved—soil cutting and soil removal. In trenching that uses conventional equipment such as that described above, hard cutting teeth or cutting edges are forced into the ground to "cut" the soil. This equipment can not only cause damage to buried utilities but it can also expose itself (the equipment) and personnel who operate it to severe hazards associated with damaged utilities. These hazards include electrocution, natural gas explosion, and water damage.

Another drawback associated with the above trenching equipment is a lack of continuity in soil cutting and soil removal. For example, a backhoe first loads its bucket which is the soil cutting phase of its operation. When the bucket is full, soil cutting must be suspended while the bucket is lifted from the excavation face to dump soil onto a pile or into a removal vehicle. This suspension of the soil cutting phase slows the potential production rate. Trenching machines attempt to provide more continuous cutting and removal. However, they still have destructive hard cutting edges or cutting teeth. Trenching machines have such a high damage potential that they are not used in locales where there is a likelihood of buried utilities.

The idea of a "soft excavator" is to use jets of air to loosen soil and the like without damage to utility lines or to other "hard" buried objects. A conventional air jet cutting device which loosens soil but which does not provide an effective means for removing loosened soil from a trench addresses only one of the two principal actions involved in excavation. As will be discussed in the following two paragraphs, a conventional soft excavator which uses a flexible hose for soil transport or which uses a tank for accumulating and holding soil has important imitations.

A soft excavator which uses a flexible hose for the transport of soil has limited throughput capacity because of the adhesive and cohesive nature of soils. Some flexible hoses, especially those for vacuum service, have a reinforcing spiral spring that forms ridges inside the hose and that can cause soil to stick to the sides of the interior of the hose. This loss of transport pipe area results in an increased pressure drop in the pipe and in less effective soil transport. Additional particles impact the sidewalls and adhere, thereby further reducing the transport area to the point where clogs could occur. The bends associated with flexible hoses also contribute to a propensity of flexible hoses to clog. Clogging is a major problem for prior art soft excavators.

Prior art soft excavators which use a tank or hopper for accumulating and holding excavated material also have limited throughput capacity because the cutting action of the excavator must be periodically stopped to permit the tank or hopper to be emptied.

SUMMARY OF THE INVENTION WITH OBJECTS

It is a general object of this invention to provide an improved apparatus for excavating trenches.

It is another object of this invention to provide an improved trencher which can excavate in areas having buried cables, pipes, and other utilities while not damaging those utilities during excavation.

It is another object of this invention to provide an improved trencher having improved trenching efficiency provided by continuous soil cutting and removal.

It is another object of this invention to provide an improved trencher which uses a vacuum system for soil removal but which is resistant to soil clogging.

It is another object of this invention to provide an improved trencher with a combined soil cutting and soil removal excavation head that develops a synergistic effect between its air jet for soil cutting and its vacuum system for soil removal.

It is another object of this invention to provide an improved trencher which has few moving parts at the excavation face.

The present invention is a novel trencher which accomplishes these and other objects by featuring the structure that is described below.

An excavation head, mounted on one end of a hollow extendible boom, has nozzles for directing jets of high speed air at an excavation face to loosen soil. The hollow of the boom acts as a vacuum transport pipe by extending from the excavation head to a spherical joint. The spherical joint movably joins a second end of the boom to a primary separator. The primary separator is a chamber for disentraining loosened soil from air flowing through the primary separator. A primary rotary-valve air lock is located at the lower portion of the primary separator for expelling soil from the primary separator. A secondary separator is joined to the primary separator by way of separator connector pipes. A secondary rotary-valve air lock is located at the lower portion of the secondary separator for expelling soil from the secondary separator. A positive-displacement vacuum pump that is a rotary blower has its vacuum side pneumatically connected to the secondary separator. A filter, cleanable using reverse pulses of air, is interposed between the rotary blower and the secondary separator to prevent soil from reaching the rotary blower. A conveyor is located such that its belt passes under both the primary air lock and the secondary air lock to receive soil that is expelled by these air locks. The conveyor is an endless loop conveyor which continuously moves soil to the other end of the trencher to a chute for discharge at a spoils discharge location.

The boom of the present invention is a straight boom which has telescoping rectilinear extension capability provided by nested tubes. A spherical joint provides a movable structural connection with two rotational degrees of freedom. The spherical joint supports the boom from the primary separator while providing a straight flow path for entrained soil to the interior of the primary separator and while making a movable seal for the vacuum within the primary separator. Hydraulic actuators lift, swing, and extend the boom such that the excavation head is positioned to a desired location on the excavation face. The spherical joint has a sphere having a groove and a restraining pin which prevent the lift-swing mechanism of the boom from locking up due to rotation.

DETAILED DESCRIPTION OF THE PRESENT INVENTION

This detailed description of the present invention will commence with a description of the overall structure of the trencher provided by the present invention by identifying the main components of the present invention as well as their interrelationships. Next described is a boom used by the present invention followed by a description of a spherical joint which joins the boom to the remainder of the trencher. The excavation head positioning apparatus is then described. Finally, three embodiments of excavation heads of the present invention are described.

DESCRIPTION OF THE OVERALL STRUCTURE OF THE TRENCHER

Figure 1:
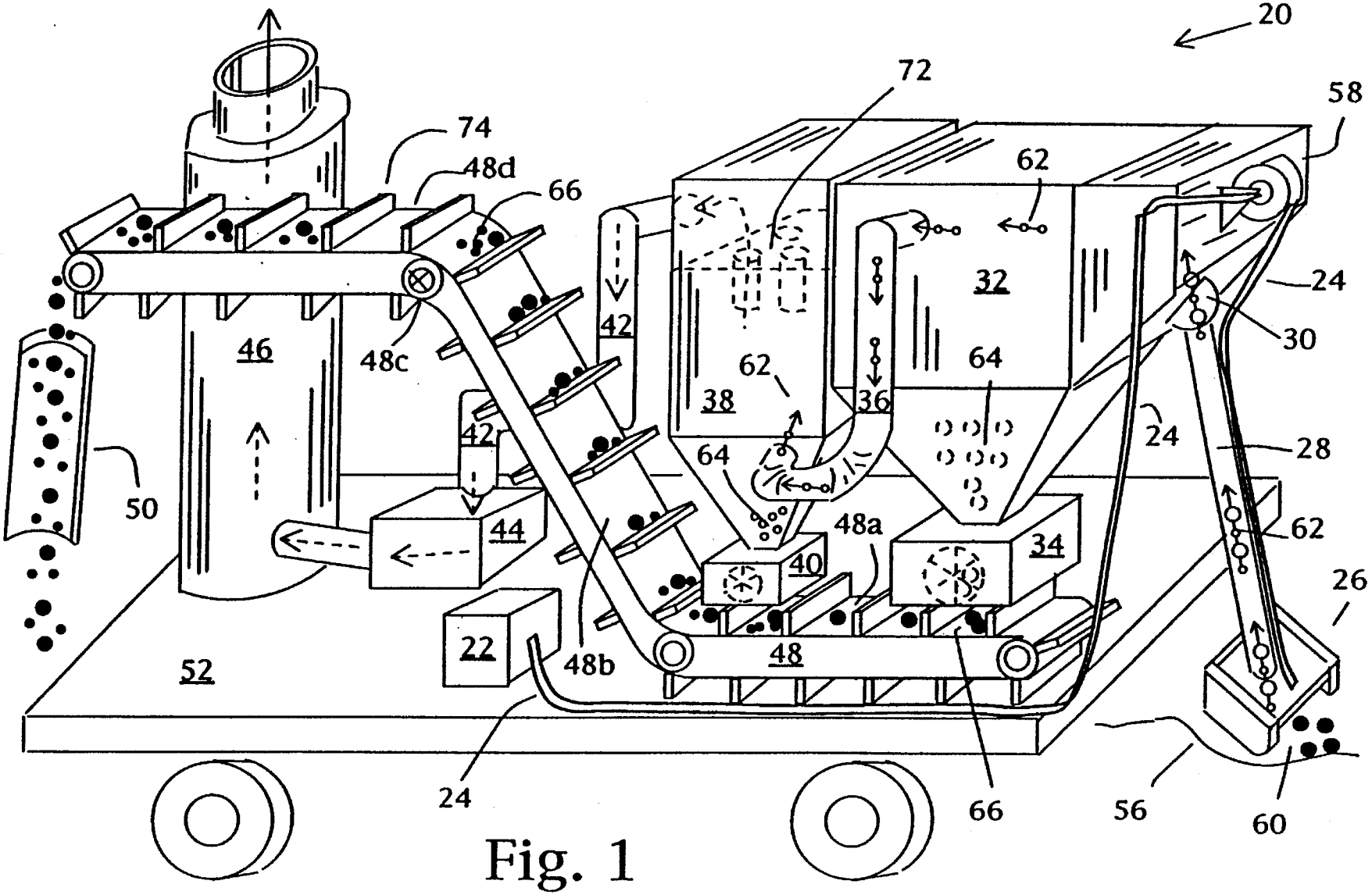
FIG. 1 is a perspective view of the trencher of the present invention, its main components, and their relative positions.

FIG. 1 shows trencher 20, its main components, and their relative positions in perspective view. FIG. 1 and other figures omit certain details of trencher 20 so that components comprising the present invention may be clearly illustrated. Main components of the trencher 20 include air compressor 22, air supply hose 24, excavation head 26, boom 28, spherical joint 30, primary separator 32, primary air lock 34, separator connector pipe 36, secondary separator 38, secondary air lock 40, rotary blower connection pipe 42, rotary blower 44, silencer 46, conveyor 48, and discharge chute 50. These components are mounted on chassis 52 of a vehicle. The individual functions and the interrelationships of the main components of trencher 20 will be described in further detail below.

Chassis 52 is supported above the ground by wheels to provide mobility for chassis 52. Excavation head 26 is mounted near what is referred to herein as the front end of trencher 20. The left side of trencher 20 and the left side of excavation head 26 are on the left with reference to the perspective of a person who is located in front of trencher 20 and who is facing rearward.

Air compressor 22 supplies high pressure air to excavation head 26 by way of air supply hose 24. Excavation head 26 directs jets of high speed air at excavation faced 56 and these jets interact with excavation face 56 to create loosened soil 60. Air compressor 22 is typically a rotary screw type air compressor capable of supplying up to 600 cubic feet of air per minute at up to 200 psig. Air compressor 22 is a 180 horsepower machine powered by a fixed displacement hydraulic motor (not shown) driven by a variable displacement hydraulic pump (not shown) which is in turn driven by a diesel engine (not shown). Air supply hose 24 is a reinforced rubber hose. When boom 28 is extended or retracted, air supply hose 24 is fed from or reeled onto hose reel 58. Hose reel 58 is mounted on primary separator 32 above spherical joint 30.

Loosened soil 60 becomes entrained soil 62 in a vacuum induced air flow under excavation head 26. This air flow flows into excavation head 26 and then flows into and through hollow boom 28. Entrained soil 62 passes through spherical joint 30 and then enters primary separator 32.

Primary separator 32 is a vacuum chamber having an entrained soil 62 receiving opening, baffles, and an air outlet. Primary separator 32 has an internal volume of approximately seventy-five cubic feet. After entrained soil 62 enters primary separator 32, the velocity of entrained soil 62 decreases due to kinetic energy loss from impact with the interior walls and baffles of primary separator 32. Deceleration of entrained soil 62 within primary separator 32 causes entrained soil 62 to become disentrained soil 64 which settles downward to the bottom of primary separator 32. The lower portions of the sides of primary separator 32 narrow in width to converge at an opening between primary separator 32 and primary air lock 34. Primary air lock 34 is fastened around that opening to the lower portion of primary separator 32.

Primary air lock 34 is a rotary-paddle type device which removes disentrained soil 64 from primary separator 32. Primary air lock 34 has a sealable passage sufficiently large to permit any excavated object that enters primary separator 32 to exit primary separator 32 by way of primary air lock 34. Primary air lock 34 expels disentrained soil 64 from primary separator 32 while maintaining a pneumatic seal between primary separator 32 and ambient air. Primary air lock 34 expels disentrained soil 64 downward onto the upper surface of conveyor 48. Soil expelled onto conveyor 48 is referred to herein as "conveyed soil 66". Primary air lock 34 is powered by a variable speed hydraulic motor (not shown).

The inventors expect that primary separator 32 will convert approximately ninety-five percent of entrained soil 62 into disentrained soil 64. Fine grained entrained soil 62 exits the air outlet of primary separator 32 and travels to secondary separator 38 by way of separator connector pipes 36. One such separator connector pipe 36 is shown on the left sides of primary separator 32 and secondary separator 38.

Although not shown, there is an additional separator connector pipe 36 joining the right-hand sides of primary separator 32 and secondary separator 38. Both separator connector pipes 36 are twelve inches in diameter. The two separator connector pipes 36 are positioned such that their outlets into secondary separator 38 are in the same horizontal plane but the two outlets are aimed in parallel but opposite directions. The positions of the outlets of the two separator connector pipes 36 are also offset from each other so that fine grained entrained soil 62 enters secondary separator 38 moving in opposite but offset directions to create a cyclone action for air flow within secondary separator 38. The cyclone effect is intended to improve the soil disentraining action of secondary separator 38.

Entrained soil 62 that reaches secondary separator 38 is of a finer average grain than entrained soil 62 entering primary separator 32 since coarse-grain entrained soil 62 is already removed by primary separator 32. Secondary separator 38 is located rearward by primary separator 32. Secondary separator 38 is of similar construction to primary separator 32. Secondary separator 38 has an internal volume of approximately 150 cubic feet. (As will be discussed in detail below, secondary separator 38 also has a filter system to prevent soil from reaching rotary blower 44). Within secondary separator 38 entrained soil 62 becomes disentrained soil 64 and disentrained soil 64 settles downward to the bottom of secondary separator 38. Secondary air lock 40 is smaller than but is of similar construction to primary air lock 34. Secondary air lock 40 expels disentrained soil 64 from secondary separator 38 downward onto conveyor 48.

Secondary separator 38 has a rotary blower connection pipe 42 which pneumatically joins the vacuum side of rotary blower 44 to an air outlet of secondary separator 38. Rotary blower 44 draws a vacuum, first in secondary separator 38. Then, by way of separator connector pipes 36, rotary blower 44 draws a vacuum in primary separator 32. There is a pneumatic path within hollow boom 28 and through spherical joint 30 that pneumatically joins primary separator 32 to excavation head 26. Accordingly, there is a pneumatic path joining rotary blower 44 and excavation head 26 so rotary blower 44 indirectly draws a vacuum beneath excavation head 26. More specifically, a vacuum is drawn in a soil removal cavity on the underside of excavation head 26. The soil removal cavity is described in further detail below and is illustrated in a subsequent drawing. Rotary blower 44 is a positive displacement vacuum pump capable of drawing a vacuum of up to twelve inches Hg vacuum at up to 4,300 actual cubic feet per minute at up to 120 bhp. Rotary blower 44 is powered by a fixed displacement hydraulic motor (not shown) supplied by a variable displacement hydraulic pump (not shown).

As discussed in the previous paragraph, rotary blower connection pipe 42 pneumatically joins the vacuum side of rotary blower 44 to secondary separator 38. Filter system 72 is located within secondary separator 38 to prevent entrained soil 62 from entering rotary blower connection pipe 42. Filter system 72 is particularly useful for preventing passage of fine grained particles of entrained soil 62 into rotary blower connection pipe 42. Filter system 72 has a horizontal tube sheet measuring four feet by five feet. The tube sheet has circular holes. A multiplicity of cylindrical filter cartridges are disposed within secondary separator 38 to hang below the tubesheet. Entrained soil 62 is retained as disentrained soil 64 on the outer surfaces of the filter cartridges, i.e., on the surfaces that are near separator connector pipe 36 and secondary air lock 40. Since uninterrupted accumulation of disentrained soil 64 on the filter cartridges would result in an excessive pressure drop across filter system 72, a soil cleaning system periodically uses reverse-pulse jets of high speed air supplied by air compressor 22 to dislodge accumulated disentrained soil 64 from the outer surfaces of the filter cartridges whenever the pressure drop across the filter cartridges reaches a predetermined level. Dislodges disentrained soil 64 then settles to the bottom of secondary separator 38 where it enters secondary air lock 40. Filter cartridges may be paper or other material. Gore Tex™ fabric is particularly adapted to filter wet entrained soil 62.

Rotary blower 44 discharges air into silencer 46. Silencer 46 is a conventional, high quality, low pressure drop silencer having a baffled internal structure.

Conveyor 48 is an endless belt having a soil carrying upper surface that continuously moves rearward. Conveyor 48 has a horizontal loading section **48*a* which extends rearward under both primary air lock 34 and secondary air lock 40. Loading section 48*a* receives conveyed soil 66 on its upper surface. Conveyor 48 moves conveyed soil 66 rearward where conveyor 48 transitions to an inclined section 48*b*. Inclined section 48*b* elevates conveyed soil 66 as conveyor 48 moves rearward to pivot point 48*c* at which conveyor 48 transitions to unloading section 48*d*. When conveyed soil 66 reaches the rearward most location of the conveyor 48 loop, unloading section 48*d* discharges conveyed soil 66 into discharge chute 50. Discharge chute 50 provides a path by which conveyed soil 66 is discharged off trencher 20 to a spoils discharge location. A hydraulic actuator may be provided at the rear of trencher 20 to raise or lower unloading section 48*d* to operator selected heights. Providing pivot point 48*c* and a hydraulic actuator to unloading section 48*d* allows conveyor 48 to remain below bridge height for transportation while permitting conveyor 48 to discharge conveyed soil 66 at higher heights (such as featured by dump trucks with raised sides) than would otherwise be feasible. The spoils discharge location may be the surface of the ground alongside trencher 20 or may be the bed of a dump truck parked alongside trencher 20**.

Conveyor 48 is sufficiently wide to receive substantially all disentrained soil 64 that is discharged by primary air lock 34 and secondary air lock 40. Conveyor 48 has cleats 74 spaced at uniform distances along conveyor 48. Cleats 74 are oriented orthogonal with respect to motion of conveyor 48 to ensure that conveyed soil 66 moves along conveyor 48 without substantial sliding on conveyor 48. Conveyor 48 moves at an operator-selected speed sufficiently fast to remove conveyed soil 66 without overflow of conveyed soil 66 over the sides of conveyor 48. Conveyor 48 is powered by a hydraulic motor (not shown).

Trencher 20, as described above, provides a continuous trenching system. This continuous trenching system continuously creates loosened soil 60, continuously moves entrained soil 62 from excavation head 26 through boom 28 and then respectively into primary separator 32 and secondary separator 38. Primary separator 32 and secondary separator 38 continuously convert entrained soil 62 into disentrained soil 64 and primary air lock 34 and secondary air lock 40 continuously expel disentrained soil 64 onto conveyor 48. Conveyor 48 continuously discharges conveyed soil 66 into chute 50 where it slides off trencher 20. The reverse-pulse cleaning provided by filter system 72 allows continuous operation of primary separator 32 and secondary separator 38. The advantages of the continuous system of the present invention are clear over a conventional system using a hopper that is filled and then is periodically emptied. It will be recalled that in such hopper systems the cutting action of the excavator is interrupted while the hopper is emptied.

A diesel engine (not shown) is the power plant for trencher 20. The engine operates several hydraulic pumps (not shown). The hydraulic pumps and associated hydraulic lines operate hydraulic actuators and extenders as well as hydraulic motors powering other equipment on trencher 20. Mechanical means of power transmission could also be used directly from the diesel engine.

DESCRIPTION OF THE BOOM

Figure 2:
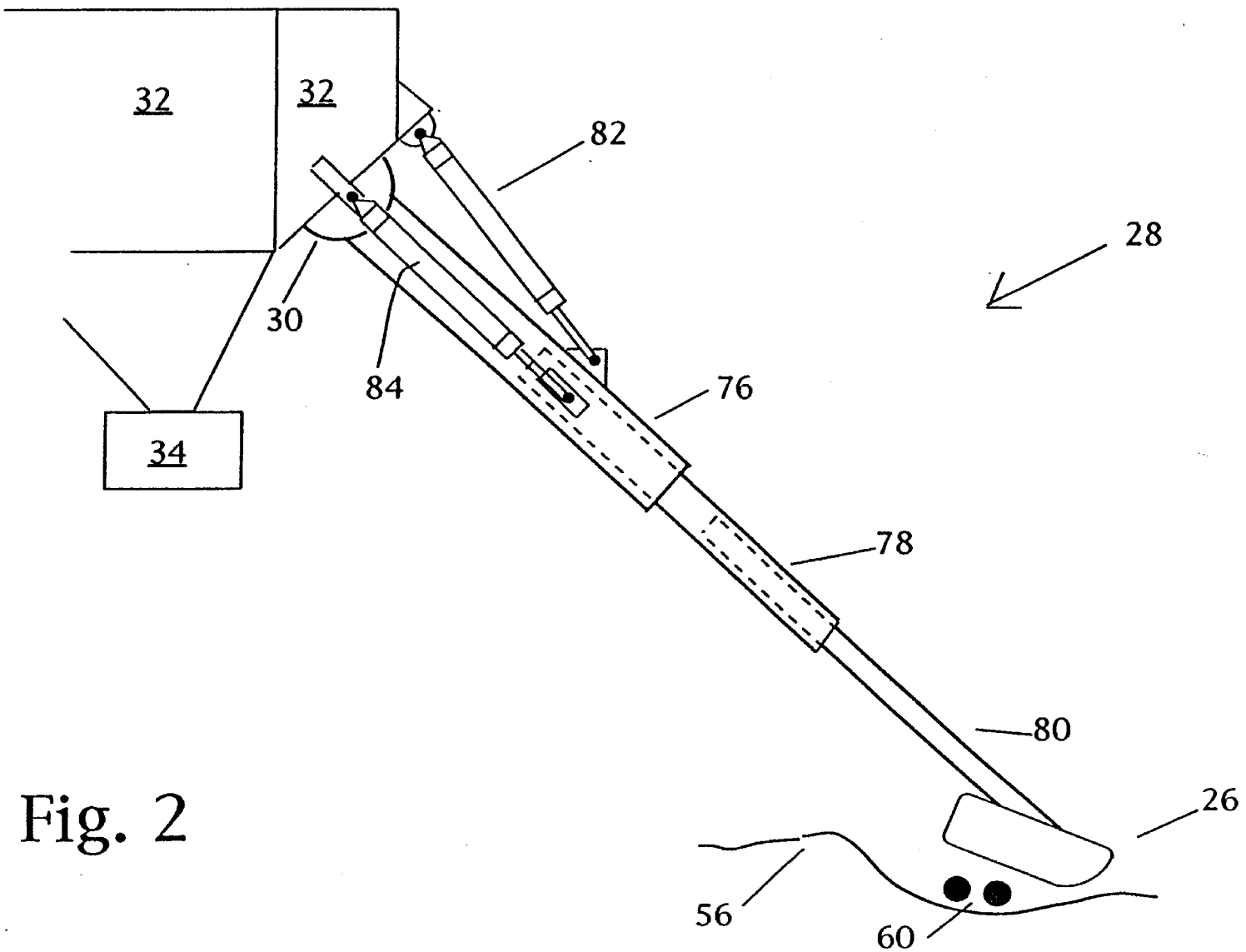
FIG. 2 is a side elevation of the boom of the present invention such that the means for swinging an end of the boom vertically and horizontally may be understood.

FIG. 2 illustrates further details of boom 28. Boom 28 is a straight, rigid boom which has telescoping rectilinear extension capability provided by support tube 76, mid-tube 78, and head tube 80. Spherical joint 30 provides a structural joint movably supporting boom 28 from primary separator 32. Lift actuator 82 moves boom 28 within nearly vertical planes and swing actuator 84 moves boom 28 from side-to-side. The combined action of lift actuator 82 and swing actuator 84 changes the angular position of boom 28 with respect to primary separator 32. A subsequent figure provides further details of boom 28.

Support tube 76 is a straight hollow steel tube having a machined interior surface. Support tube 76 need not necessarily be constructed of steel. Mid-tube 78 is a straight tube nested within support tube 76. Mid-tube 78 has an exterior surface machined to match the interior surface of support tube 76 and to allow mid-tube 78 to slide longitudinally within support tube 76. Mid-tube 78 has a machined interior surface sized to receive head tube 80. Head tube 80 has an exterior surface machined to match the interior surface of mid-tube 78 and to allow head tube 80 to slide longitudinally within mid-tube 78. When mid-tube 78 and head tube 80 are extended or retracted then the distal end of head tube 80 is further or closer, respectively, from spherical joint 30. Accordingly, boom 28 provides a range of rectilinear motion for excavation head 26. The three tubes have bearings and seals to permit their airtight relative motion.

The interior of boom 28 provides a smooth, straight-line flow path for entrained soil 62 to flow from excavation head 26 to primary separator 32. This interior of boom 28 is provided by the interiors of support tube 76, mid-tube 78, and head tube 80 as well as spherical joint 30. This smooth, straight-line flow path is superior to paths provided by conventional flexible hoses which have bends or internal ribs which restrict air flow and which tend to accumulate soil causing increased pressure drops and reduced soil removal effectiveness.

Lift actuator 82 is a linear hydraulic cylinder actuator. Lift actuator 82 is a double-acting cylinder which uses hydraulic fluid to both extend and retract lift actuator 82. Lift actuator 82 has its cylinder end mounted on primary separator 32 above spherical joint 30. Lift actuator has its piston end mounted on the upper side of support tube 76. Lift actuator 82 and swing actuator 82 are of similar construction and capacity. Swing actuator 84 has its cylinder end mounted on the left side of primary separator 32 and its piston end mounted on the left side of support tube 76.

Figure 3:
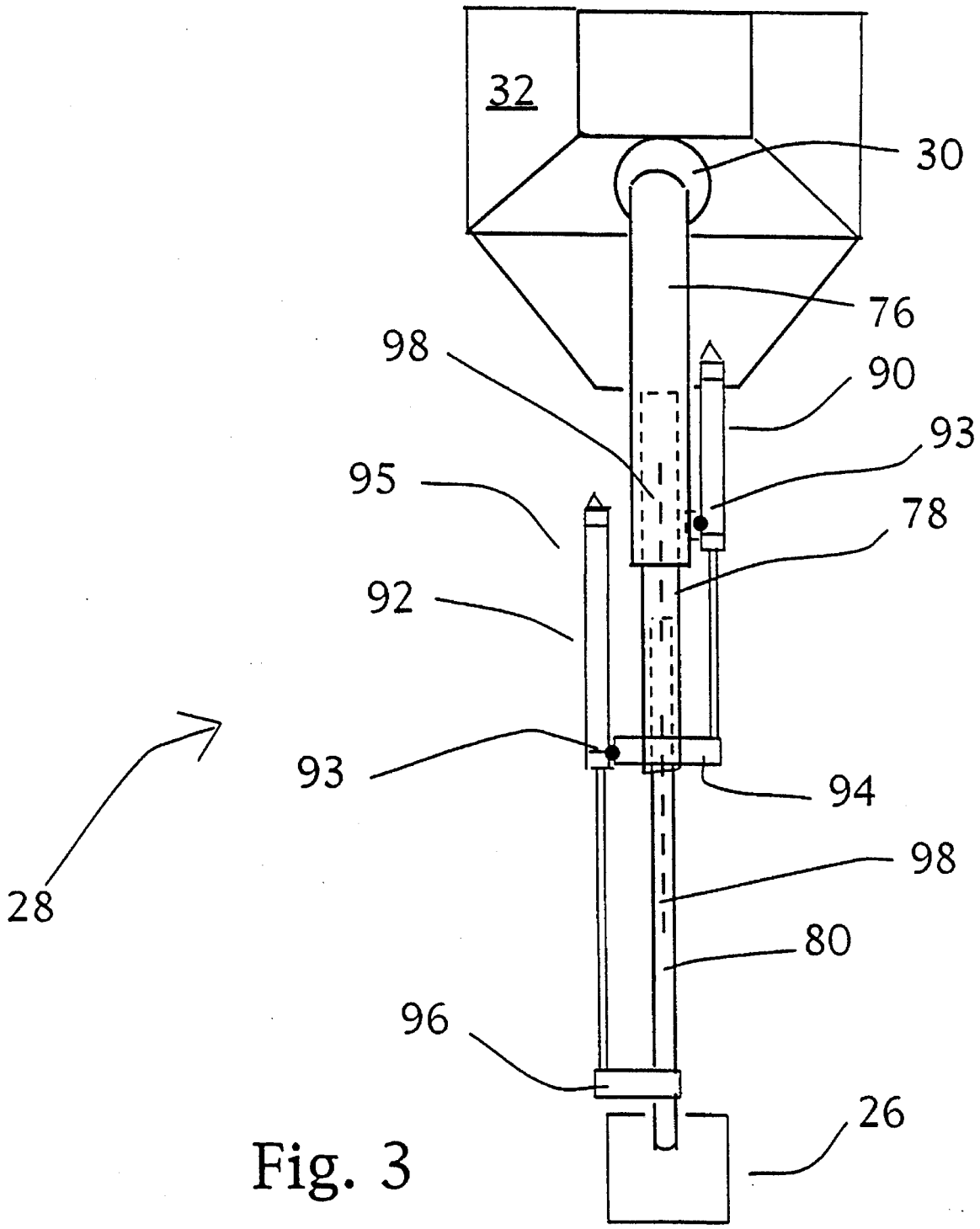
FIG. 3 is a front elevation of the boom of the present invention such that the means for extending and retracting the boom may be understood.

FIG. 3 illustrate still further details of boom 28. Mid-tube extender 90 and head tube extender 92 extend and retract head 26 with respect to spherical joint 30. Mid-tube extender 90 is a linear hydraulic cylinder actuator. Mid-tube extender 90 is a double-acting cylinder which uses hydraulic fluid to both extend and retract mid-tube extender 90. Mid-tube extender 90 and head tube extender 92 are of similar construction but mid-tube extender 90 is of larger capacity than head tube extender 92.

Mid-tube extender 90 has its cylinder end mounted by trunnion 93 to the front end of support tube 76. Mid-tube extender 90 has its piston and mounted on collar 94 which is fixed near the front end of mid-tube 78. Head tube extender 92 has its cylinder end mounted by another trunnion 93 to the front end of mid-tube 78. The piston end of head tube extender 92 is mounted on collar 96 which is fixed near the front end of head tube 80.

Support tube 76, mid-tube 78, and head tube 80 have key and keyway assemblies 98 that are longitudinal along the tube lengths in order to prevent rotation of the tubes relative to each other.

It should be noted that while FIG. 2 illustrates lift actuator 82 and swing actuator 84 and while FIG. 3 illustrates mid-tube extender 90 and head tube extender 92, in actuality, boom 28 of the present invention contemporaneously uses all four of those elements. Thus, while FIG. 2 omits mid-tube extender 90 and head tube extender 92, they are omitted for clarity of illustration. They actually operate in concert with lift actuator 82 and swing actuator 84. Similar comments apply to FIG. 3 which, for clarity of illustration, omits lift actuator 82 and swing actuator 84.

DESCRIPTION OF THE SPHERICAL JOINT

Figure 4:
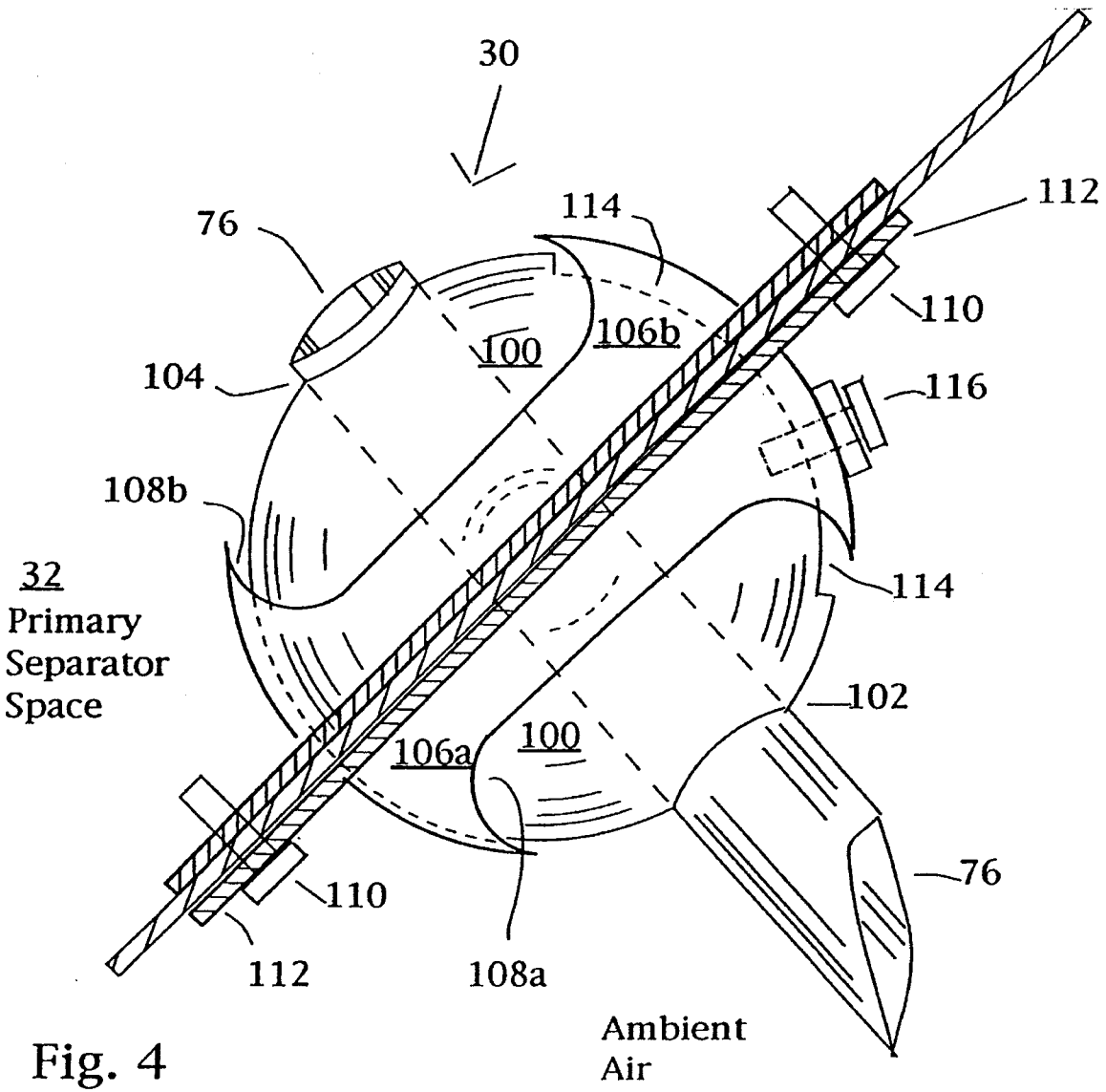
FIG. 4 is a side elevation in partial section which illustrates details of the spherical joint of the present invention.

FIG. 4 illustrates spherical joint 30 in further detail. The rear end of support tube 76 extends through sphere 100 into primary separator 32. The longitudinal axis of support tube 76 passes through the center of sphere 100 and is fixed to sphere 100 by front weld 102 and rear weld 104.

The configuration of sphere 100 and support tube 76 provides an unobstructed, smooth, straight passage for soil and air to pass through support tube 76 through sphere 100 into primary separator 32. Thus, spherical joint 30 maintains a straight line path for entrained soil 62 within boom 28 to flow into primary separator 32 while allowing for side-to-side, up-and-down, and combination motions of boom 28.

Retainer 106 is comprised of two flanged hemispherical retainer caps **106*a* and 106*b* to provide a spherical cavity. The retainer 106 receives sphere 100 concentrically within that spherical cavity. The flanges of retainer caps 106*a* and 1-6*b* are fastened to the wall of primary separator 32. Retainer cap 106*a* is fastened outside primary separator 32 while retainer cap 106*b* is fastened inside primary separator 32. The flanges of retainer caps 106*a* and 106*b* are fastened adjacent to each other to provide the spherical cavity of retainer 106. Retainer 106 has an inner diameter that is slightly larger than the outer diameter of sphere 100. The cavity of retainer 106 is lined with a layer of low friction bearing material such as Teflon™ coated material to reduce friction between sphere 100 and retainer 106 and provide a movable air seal. Retainer caps 106*a* and 1-6*b* have squarish openings 108*a* and 108*b*, respectively, which are generally square-shaped but which have rounded corners to provide the desired range of motion for boom 28. Support tube 76 projects forward through retainer 106 by way of squarish opening 108*a*. Squarish opening 108*b* provides an opening for fluid communication between the rear end of support tube 76 and the interior of primary separator 32. A key benefit provided by boom 28 and spherical joint 30 is that they provide a linear flow path between head 26 and primary separator 32**. In other words, this flow path lacks bends and is therefore resistant to clogging.

Bolts 110 through linear flange 112 fixedly secure retainer cap **106*a* to primary separator 32. Retainer 106 permits sphere 100 to rotate about the center of sphere 100 within retainer 106 to permit changes in the angular relationship of boom 28 and primary separator 32. In addition to providing the combination of angular motions, spherical joint 30 functions as a bearing to react the forces of boom 28 and to provide a low-leakage air seal for primary separator 32** which must maintain its vacuum.

Figure 5:
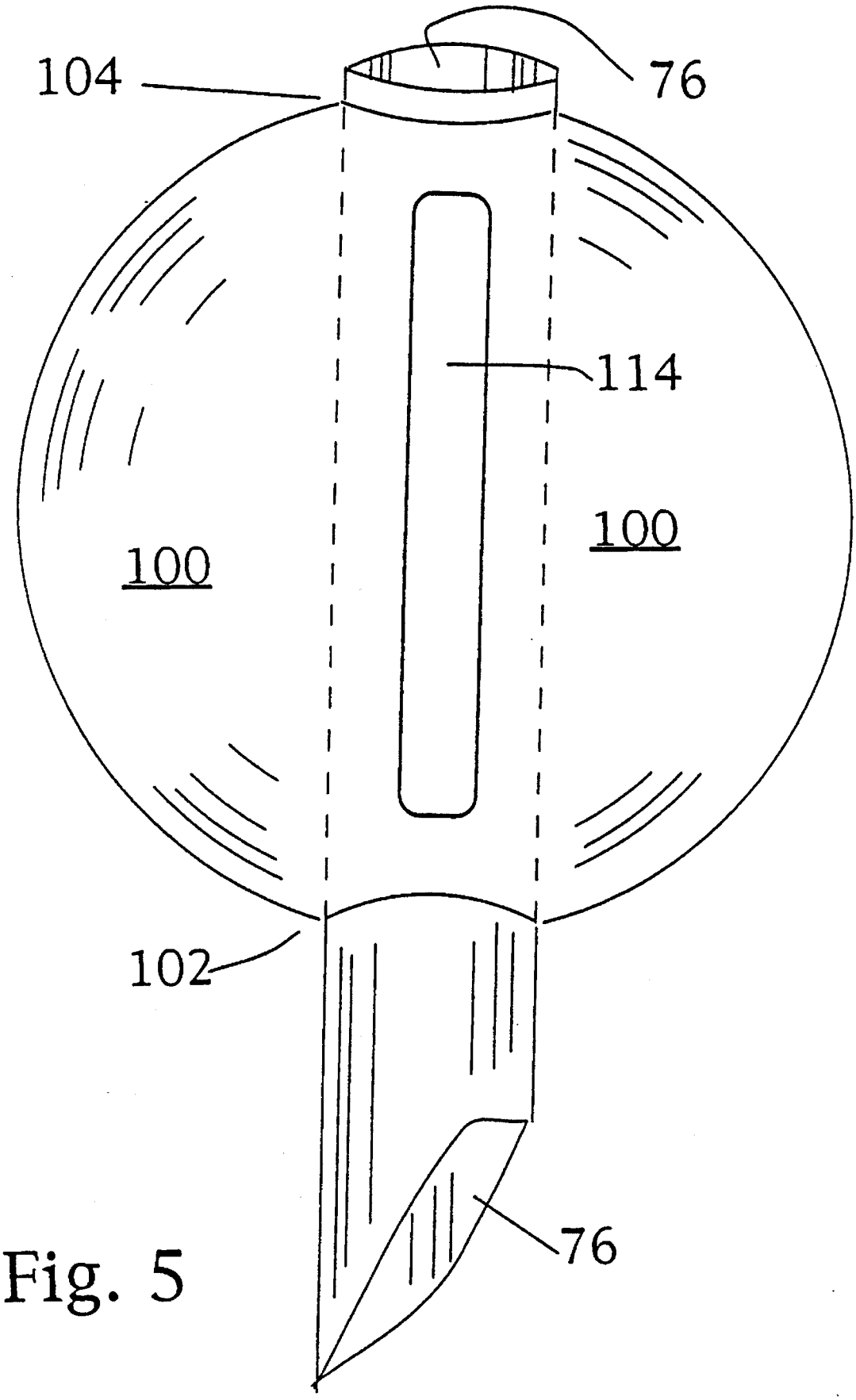
FIG. 5 is a front elevation of a sphere used in the spherical joint which shows a groove for a restraining pin which groove is cut through the sphere.

Groove 114 is cut through sphere 100. Groove 114 is longitudinally aligned with the longitudinal axis of support tube 76 as is illustrated by FIG. 5. Now returning to FIG. 4, restraining pin 116 is a cylinder-shaped pin which projects through groove 114 into sphere 100. The longitudinal axis of restraining pin 116 is aligned radially with respect to the center of sphere 100. Restraining pin 116 prevents rotation of sphere 100 about the longitudinal axis of support tube 76. A spherical joint can provide up to three angular orthogonal degrees of freedom. With two perpendicular angular degrees of freedom provided by the lift and swing, the third possible degree of freedom is a rotation about the axis of boom 28. This third degree of freedom is not desirable because it would cause the lift-swing mechanism provided by lift actuator 82 and swing actuator 84 to lock up. This lock-up problem is solved by restraining pin 116.

Figure 6:
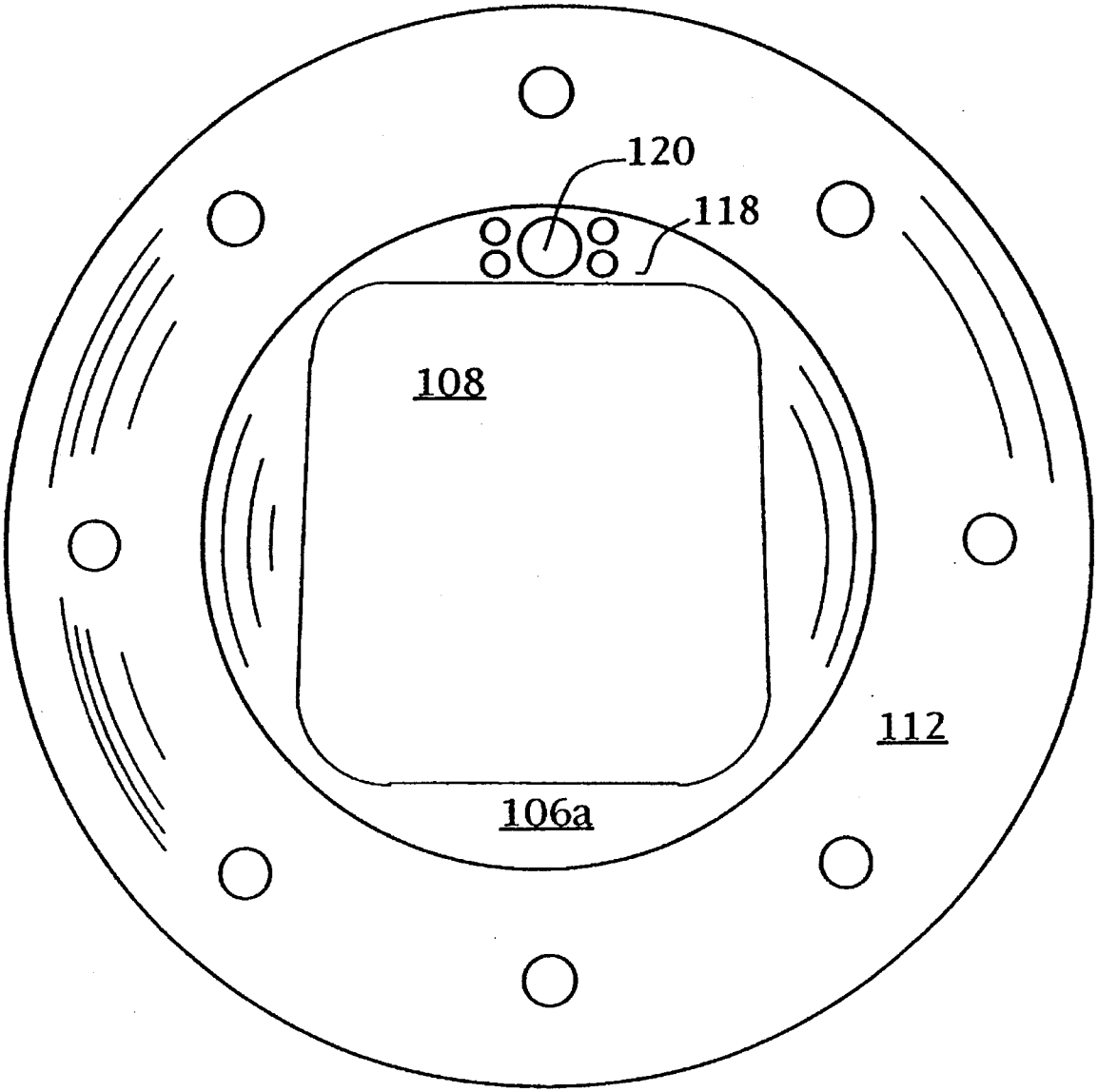
FIG. 6 is a plan view of one of two hemispherical retainers which comprise a part of the spherical joint of the present invention.

As is illustrated by FIG. 6, restraining pin 116 is fixed to retainer cap **106*a* by bolts through mounting holes 118 to primary separator 32. Restraining pin 116 projects through retainer cap 106*a* by way of restraining pin hole 120**.

DESCRIPTION OF THE EXCAVATION HEAD POSITIONING APPARATUS

An operator of trencher 20 selectively positions excavation head 26 at particular locations at excavation face 56 using a combination of systems as described in the following paragraphs. A man-machine interface system provides operator controls for these systems. This man-machine interface is provided by a remote control box (not shown) connected by a multichannel umbilical cable to the other control electronics of trencher 20. The operator normally stands alongside the trench being excavated and controls trencher 20 using the remote control box. Among the possible excavation head 26 positioning motions available are straight line motion in line with a trench in which the trench width is approximately the same as the head width, side-to-side motion for excavations wider than the width of excavation head 26, and vertical bore hole motion.

Chassis 52 is supported on a self-propelled and rubber-tired vehicle but may be provided with other means for locomotion such as crawler treads. Trencher 20 is not designed for highway travel but is instead transported to the excavation site using a low-boy trailer. Alternate designs could allow highway travel for trencher 20. Once at the excavation site, the operator moves chassis 52 on its rubber tires to a selected location for excavation. Excavation head 26 is moved with respect to chassis 52 as described in the following paragraphs.

Lift actuator 82 and swing actuator 84 move boom 28 vertically and from side to side, respectively, to change the angular relationship of boom 28 and retainer 106. Such movement rotates sphere 100 about its center. Mid-tube extender 90 and head tube extender 92 provide rectilinear positioning of excavation head 26 at selectable distances from sphere 100.

Boom 28 has a resting position in which the axis of boom 28 is vertical, boom 28 being supported from above by spherical joint 30. Boom 28 may be raised fifty degrees from its resting position. Boom 28 may be moved from side-to-side between the range of twenty-five degrees left of its resting position to twenty-five degrees right its resting position. Greater or lesser angles could be accommodated by design up to structural limits.

The line of pivoting action of lift actuator 82 and the line of pivoting action of swing actuator 84 work on two perpendicular lines passing through the center of sphere 100. This results in a decoupling of movement caused by lift actuator 82 from movement caused by swing actuator 84 such that there is a minimum interaction between lift and swing degrees of freedom of boom 28 so that they can be controlled independently.

Excavation head 26 may be moved rectilinearly within the range of approximately ninety inches from sphere 100 at its closest distance to sphere 100 (boom fully retracted) to approximately 230 inches from sphere 100 at its furthest distance from sphere 100 (boom fully extended). These measurements to excavation head 26 are nominal with bayonet-style mount 122 being the particular location on excavation head 26 for the distances just described.

DESCRIPTION OF EXCAVATION HEADS

Figure 7:
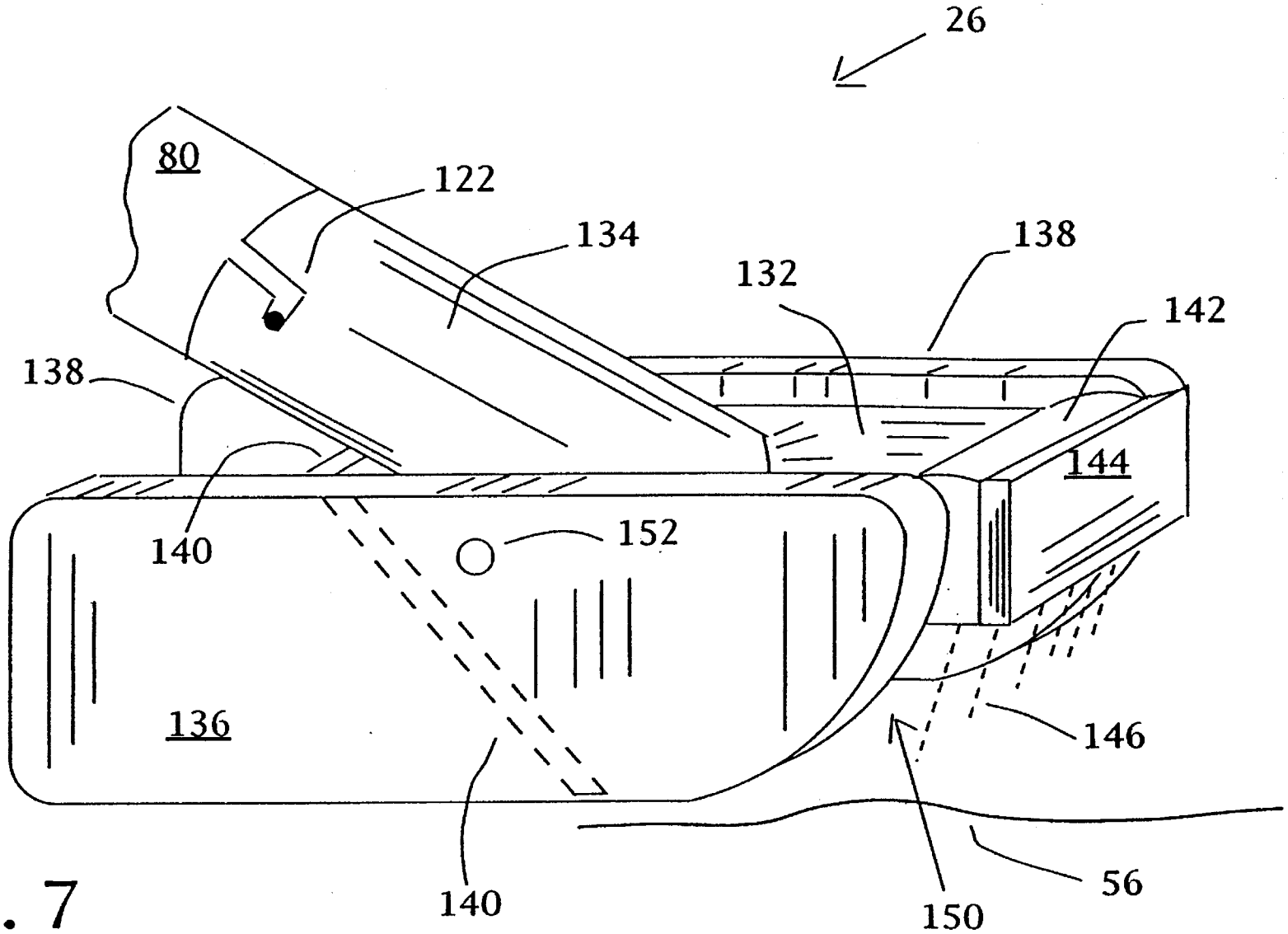
FIG. 7 is a perspective view, viewed from the upper left, of a first embodiment of an excavation head of the present invention.

FIG. 7 provides a perspective view of excavation head 26 viewed from the upper left-front of excavation head 26. Excavation head 26 provides for continuous and simultaneous cutting and removal of soil from excavation face 56.

Excavation head 26 is removably mounted to head tube 80 using bayonet-style mount 122. Excavation head 26 has bayonet-style mount 122, hood 132, vacuum transport pipe 134, left skirt 136, right skirt 138, skirt seal 140, nozzle bank 142, and bumper 144. Hood 132 is a nominally rectangular structure. Hood 132 and the parts supported by hood 132 comprise excavation head 26. Bayonet-style mount 122 on transport pipe 134 allows excavation head 26 to be conveniently removed and exchanged to allow for a variety of different shapes and widths. Excavation head 26 provides smooth geometric transitions from the front of hood 132 (i.e., under nozzle bank 142) to the round cross section of the entrance to vacuum transport pipe 134.

Nozzle bank 142 is fixedly attached along the front edge of hood 132. Bumper 144 is attached to nozzle bank 142 and is located at the front of excavation head 26. Jet axes 146, that is, axes of air jets issuing from nozzle bank 142, are shown in dashed lines projecting downward from nozzle bank 142. The angles with respect to hood 132 of jet axes 146 may be made adjustable to accommodate different excavation conditions.

Left skirt 136 and right skirt 138 project from hood 132 to excavation face 56 and are perpendicular to excavation face 56. Left skirt 136 and right skirt 138 are approximately rectangular. The lower edges of left skirt 136 and right skirt 138 touch excavation face 56 and glide along excavation face 56 during excavation.

Pivot 152 rotatably fixes left skirt 136 to hood 132. Pivot 152 permits left skirt 136 to pivot within the plane of left skirt 136 such that the lower edge of left skirt 1367 is able to lie against excavation face 56 even though the orientation of excavation face 56 may change due to movement of excavation head 26. The pivot action of left skirt 136 and right skirt 138 described in this paragraph is restricted rotation across a sector of approximately twenty degrees. Not shown in this drawing is a pivot for right skirt 138. The pivot for right skirt 138 similarly permits right skirt 138 to pivotally lie against excavation face 56.

The function of left skirt 136 and right skirt 138 is to form the side walls of soil removal cavity 150. Left skirt 136 and right skirt 138 are, as mentioned above, pivoted to allow low gliding force over any utility that may be uncovered during excavation. The lower edges of left skirt 136 and right skirt 138 provide adequate soil contact area to result in low contact pressure. This low contact pressure provides a minimum of interaction with encountered utilities and helps to avoid damage to such utilities. Left skirt 136 and right skirt 138 are made of a low friction, semi-rigid, non-sparking, and electrically insulating material with good wear properties. An example of such a material is ultra-high molecular weight (UHMW) polyethylene plastic.

Skirt seal 140 is rectangle-shaped, is located at the rear of excavation head 26, and is mounted to hood 132 along the upper edge of skirt seal 140. Skirt seal 140 thus laterally extends between left skirt 136 and right skirt 138. The upper edge of skirt seal 140 is fastened to hood 132. Skirt seal 140 projects from hood 132 to excavation face 56 such that the lower edge of skirt seal 140 touches excavation face 56. Skirt seal 140 is disposed at an angle with excavation face 56 which is approximately equal to the angle between the longitudinal axis of boom 28 and excavation face. Skirt seal 140 is made of a rubber or flexible polymeric material. Skirt seal 140, along with left skirt 136 and right skirt 138, acts as a seal and as a soil deflector.

Soil removal cavity 150 is below hood 132 and is defined by hood 132, left skirt 136, right skirt 138, and skirt seal 140. During excavation, soil removal cavity 150 covers excavation face 56 with the lower edges of left skirt 136, right skirt 138, and skirt seal 140 gliding over excavation face 56. Vacuum transport pipe 134 is an opening for air and soil under hood 132 to enter the interior of head tube 80 for flow through boom 28.

In order to be most effective, soil removal cavity 150 must be placed close to excavation face 56. Effectiveness of removal of loosened soil 60 occurs due to the close proximity between the opening to vacuum transport pipe 134 and excavation face 56 (approximately three to six inches) and due to the relatively high air velocity within vacuum transport pipe 134. The velocity of air moving throughout vacuum transport pipe 134 is sufficient to assure transportation of soil and most rocks up to several inches in diameter. Rocks having sizes even approaching the inside diameter of head tube 80 are lifted effectively up through the head tube. The resolved weight of excavation head 26 due to gravity provides sufficient downward force to maintain the close proximity of excavation head 26 to excavation face 56. Additionally, excavation head 26 is held at excavation face 56 by the excavation head positioning apparatus described above. Left skirt 136 and right skirt 138 serve as glide shoes to allow excavation head 26 to glide along excavation face 56.

Figure 8:
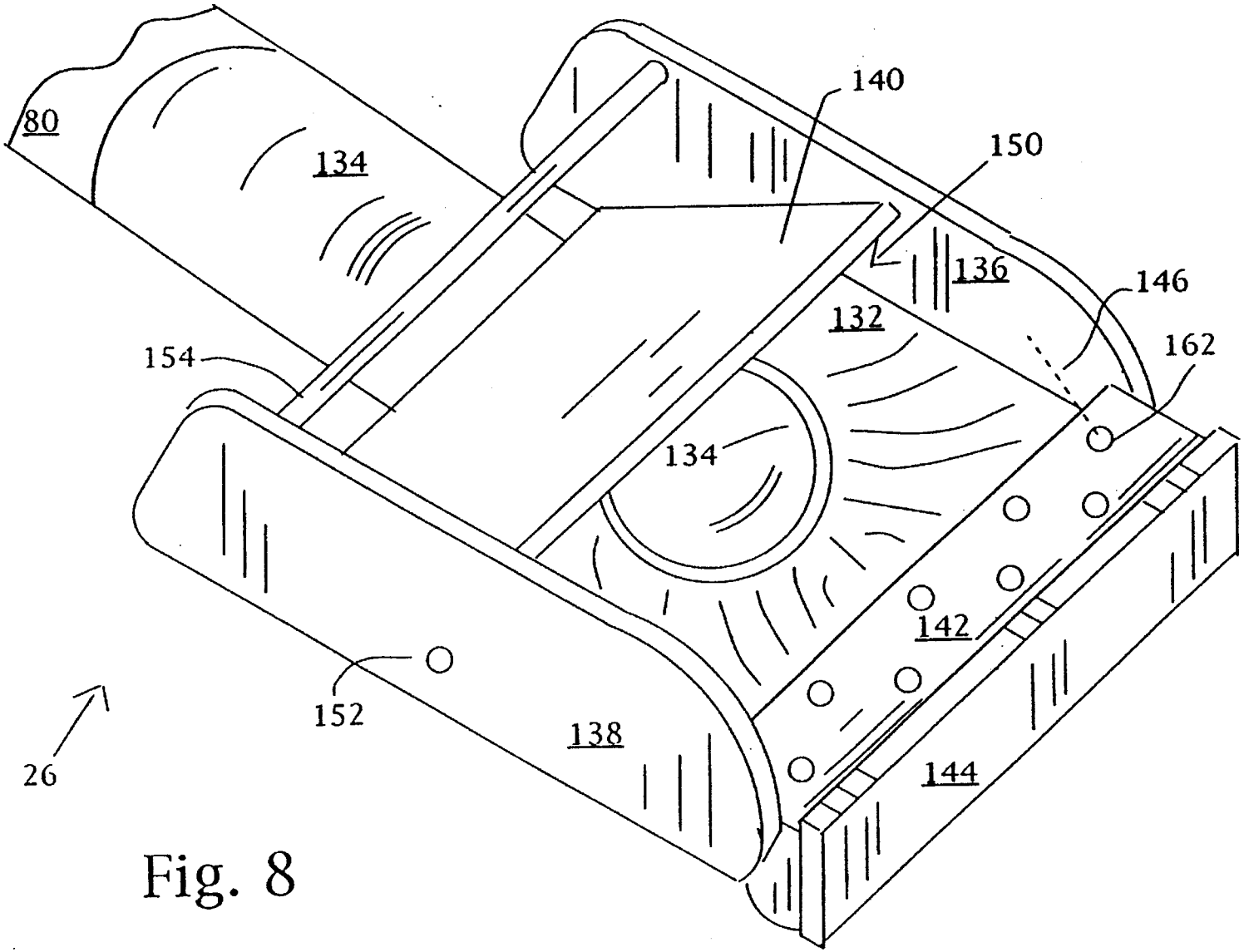
FIG. 8 is a perspective view, viewed from below, of the first embodiment of an excavation head of the present invention.

FIG. 8 provides a view of excavation head 26 from below. Nozzle bank 142 has nozzles 162 which are evenly spaced across nozzle bank 142. The entrance to vacuum transport pipe 134, which is near the rear of excavation head 26, extends through hood 132. Transport pipe 134 provides a soil and air flow path from soil removal cavity 150 into head tube 80. The rectangular area under nozzle bank 142 transitions to the round area of the entrance to vacuum transport pipe 134 in a rounded, very gradual manner. This gradual, rounded transition is provided so that loosened soil 60 does not tend to adhere to the excavation head 26 surfaces that define soil removal cavity 150.

Left skirt 136 and right skirt 138 are fixedly connected by rigid tie rod 154 joining them both. Tie rod 154 ensures that left skirt 136 and right skirt 138 rotate at identical angles with respect to hood 132. Alternatively, tie rod 154 may be omitted, thereby allowing left skirt 136 to pivot at independently of pivot by right skirt 138. Alternately, left skirt 136 and right skirt 138 may be rigidly attached to excavation head 26 and pivot 152 omitted.

Figure 9:
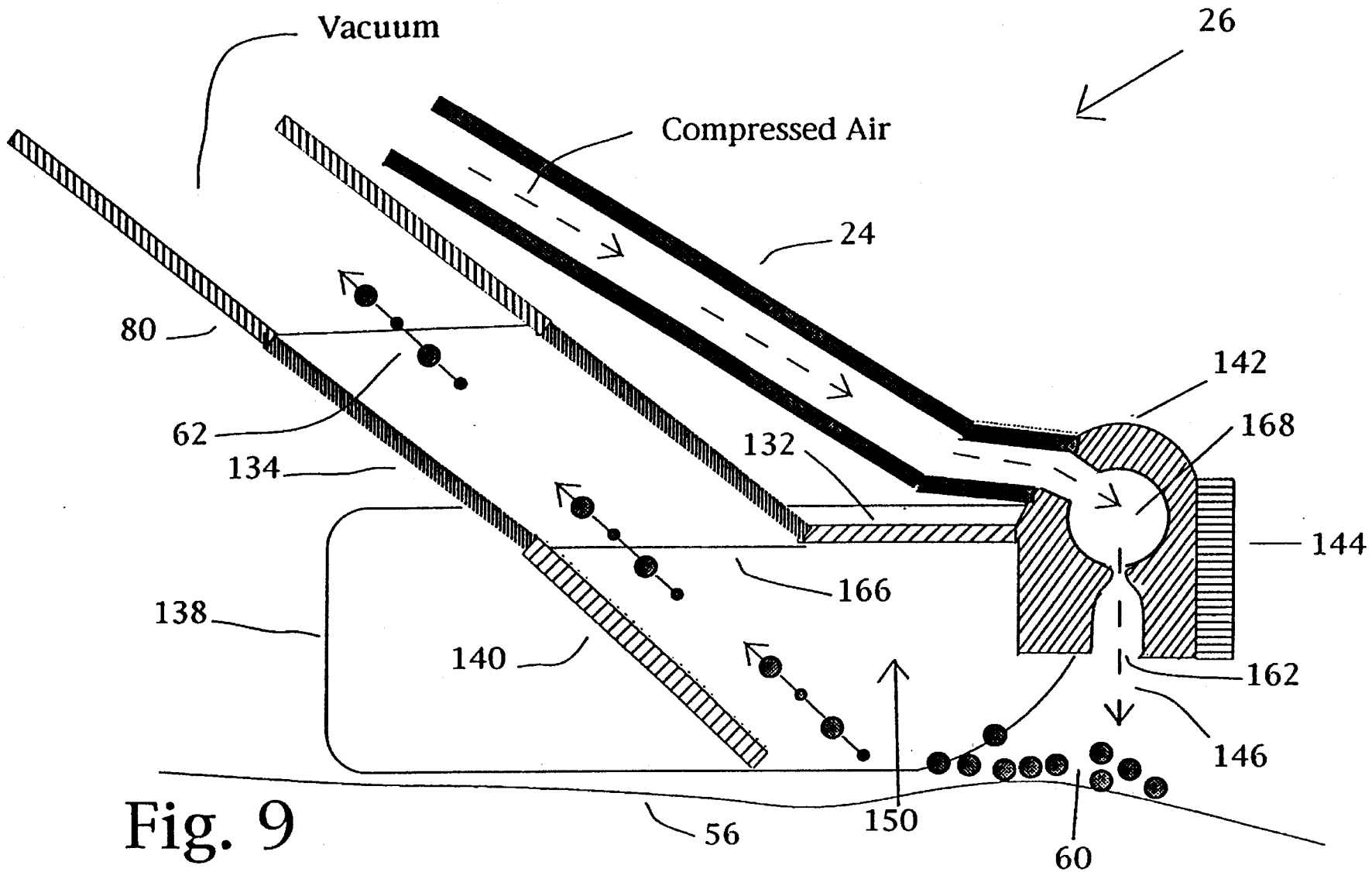
FIG. 9 is a side elevation view in section showing entrained soil flowing through the first embodiment of an excavation head of the present invention.

FIG. 9 shows entrained soil 62 flowing through excavation head 26. Air supply hose 24 supplies high pressure air to nozzle bank 142. Air supply hose 24 preferably has a quick-disconnect fitting (not shown) to allow for convenient removal of excavation head 26 from trencher 20. After entering nozzle bank 142, high pressure air enters manifold 168 which is a common supplier of high pressure air to all nozzles 162. High pressure air passes through nozzles 162 and is converted to high speed air. The high speed air flows to excavation face 56. At excavation face 56, the high speed air causes soil to loosen and separate from excavation face 56. Loosened soil 60 enters soil removal cavity 150 and comes under the influence of the vacuum drawn by rotary blower 44. That vacuum is drawn into soil removal cavity 150 by way of head tube 80 and by way of vacuum transport pipe 134, respectively. After coming under the influence of the vacuum, loosened soil 60 becomes entrained soil 62 as it is entrained in the vacuum induced air stream. This air stream enters vacuum transport pipe 134 and continues its flow into head tube 80 and then flows further into trencher 20 as described elsewhere in this disclosure.

In conventional negative pressure pneumatic transport systems, such as vacuum cleaners, the system must rely on the aerodynamic drag force on the particles or objects which drag force is produced by the in-rushing air entering a pipe or hose to accelerate the particles. When particles are at rest near a surface, the air velocity near the surface and near those particles is usually lower than the velocity of the surrounding air stream. Thus it is difficult for a vacuum system to accelerate and capture the particles from the surface.

In the present invention, cooperation between the air jets issuing from nozzles 62 and the opening of the vacuum transport system at the entrance to transport pipe 134 occurs. Particles of loosened soil 60 become airborne from the soil loosening process. As particles of loosened soil 60 are put into motion by air jets, particles are raised above the local surface. Many of the particles also have a velocity component in the direction of the in-rushing air at the excavation head 26. Because many of the particles have been accelerated in the direction of inflow into the entrance to vacuum transport pipe 134, less work is necessary to get the particles into vacuum transport pipe 134. Those particles that have other directions of velocity also contribute to the combined action of the system when they are raised above the surface and into the higher velocity air stream, where the drag force on the particles will be higher. Skirt seal 140, along with left skirt 136 and right skirt 138, acts as a seal against the airborne soil particles escaping soil removal cavity 150. Skirt seal 140 deflects particles into vacuum transport pipe 134, further promoting a cooperative effect.

Generally, the width of excavation head 26 is approximately equal to the trench width dug by excavation head 26. Similar to the procedures for using a backhoe, an operator will choose different excavation heads to dig trenches of different widths. In the embodiment of trencher 20 actually reduced to practice, the width of excavation head 26 is twenty-two inches. Wider excavation heads would require greater compressor 22 capacity. In this embodiment, nozzles 162 have their jet axes 146 aimed parallel to planes defined by left skirt 136 and right skirt 138.

In order to provide a greater nominal width of excavation coverage than that described in the previous paragraph, the left-most nozzle 162 and the right most nozzle 162, may perhaps be aimed (at an angle, perhaps, between zero and ten degrees) to reach beyond the width of excavation head 26. This will provide a cutting width in excess of the width of excavation head 26.

The "soft cutting" of the air jets can be thought of as a "non contacting" form of cutting. Although the jets of high speed air effectively attack soils via their porosity, it is harmless to non-porous materials such as utility pipes and cables since high speed air just flows around them. These air jets are excellent tools for exposing buried utility lines such as electric power cables; plastic, clay, or metal pipes; and telephone, television, or fiber optic cables without damage.

Each nozzle 162 provides a soil loosening capability that extends about one to two inches in radius around the jet axis 146. The radius of effectiveness depends upon the characteristics of soil being excavated as well as nozzle 162 design. Loosening action of nozzles 162 also depends upon their orientation and may be further adjusted by adjusting the pressure of the high speed air supplied to nozzles 162. For soil, the depth of air penetration and soil removal is preferably about three to four inches. The loosening action of nozzles 162 should be balanced to match the vacuum transport removal ability of trencher 20 so that the maximum amount of soil is excavated and so that a combined action between the high speed air cutting jets and the vacuum removal system of trencher 20 is accomplished.

Nozzles 162 are a converging-diverging type which accelerate high pressure air into highly focused jets moving faster than the speed of sound if properly shaped and if the outlet pressure to the nozzle is sufficiently above atmospheric pressure. Jet velocity and pressure are determined by conventional methods of compressible gas dynamics. Conveniently, the 100 psig output from commercially available air compressors will accelerate the compressed air to Mach 2 (twice the speed of sound) and will fracture most soils, except for plastic clays or hard pan. Higher velocity or greater pressure air may be used for more vigorous cutting action. The high speed air jets penetrate porous soil and air from these jets then stagnates in pores of the soil below excavation face 56. This stagnation causes the air to become re-compressed. The re-compressed air reacts against the porous soil structure and exceeds the strength of the soil causing the soil to fail and become loosened soil 60. The pressure of air inside the soil fractures it and the subsequent expansion of air to atmospheric pressure dislodges loosened soil 60 from excavation face 56 and launches loosened soil 60 into soil removal cavity 150.

For best cutting efficiency, jet axes 146 preferably act on lines disposed on an angle nearly perpendicular to the excavation face 56. Such lines are parallel with the planes defined by left skirt 136 and right skirt 138. However, the angle of jet axes 146 is preferably left adjustable to accommodate varying soil conditions. Moreover, individual nozzles 162 are preferably parts that are replaceable into manifold 168 such that different nozzle sizes can be substituted depending upon the particular conditions prevailing at a particular excavation face 56.

Figure 10:
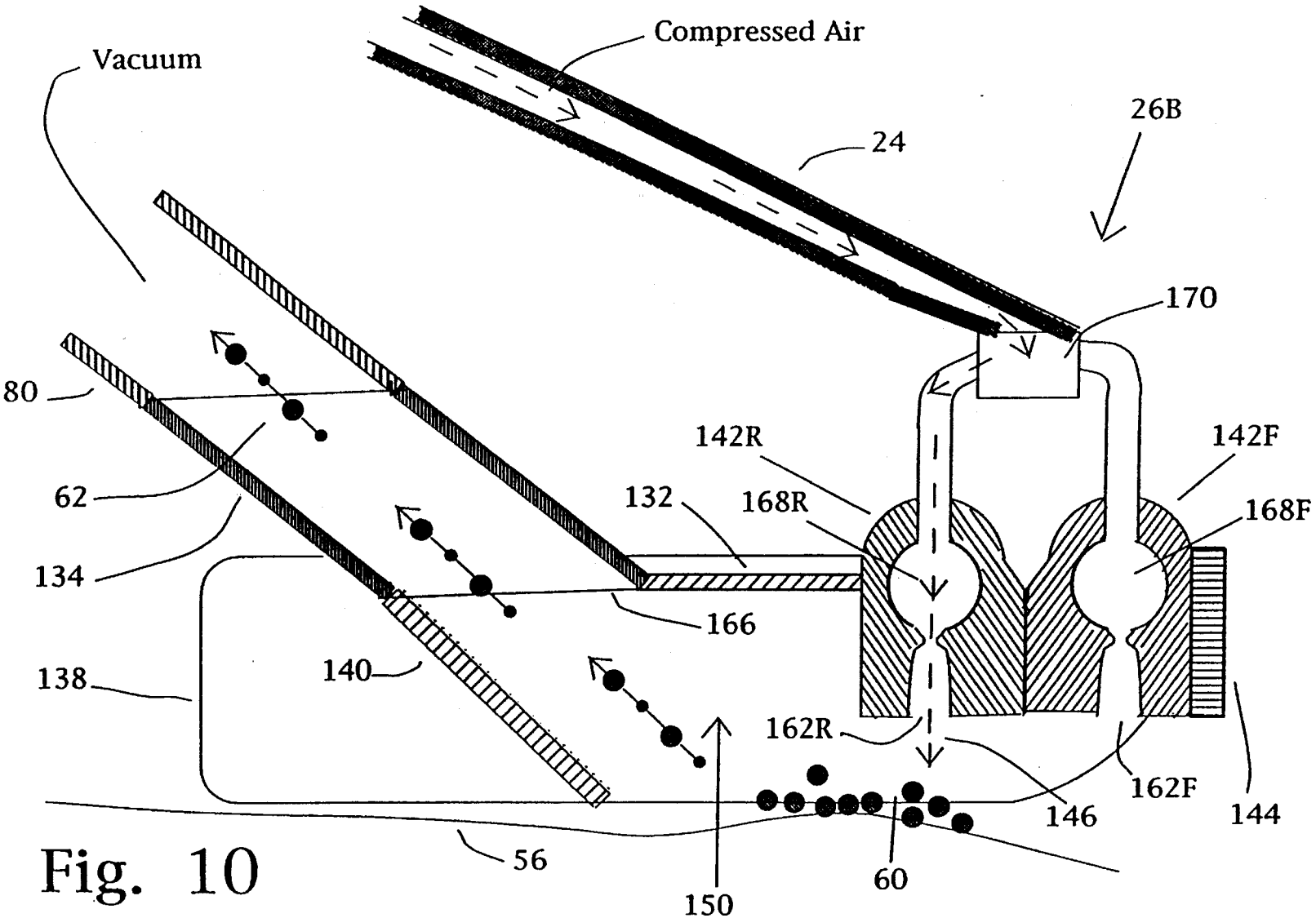
FIG. 10 is a side elevation view in section showing the flow of entrained soil through a second embodiment of an excavation head of the present invention.

FIG. 10 provides a schematic sectional view showing the flow of air and soil through excavation head 26B which is an alternative embodiment of excavation head 26. Excavation head 26B has rear nozzle bank 142R which is located parallel with and rearward of front nozzle bank 142F. Front nozzle bank 142F of excavation head 26B corresponds to nozzle bank 142 of excavation head 26 of FIGS. 7, 8, and 9. Front nozzle bank 142F and rear nozzle bank 142R are substantially the same in construction, operation and function. Minor differences may be provided between the two nozzle banks to facilitate supply of high pressure air to the two nozzle banks.

Individual nozzles 162R of rear nozzle bank 142R are not located in parallel with (i.e., not immediately rearward) of a corresponding nozzle of front nozzle bank 142F. Nozzles 142F of front nozzle bank 142F and 162R of rear nozzle bank 142R are preferably disposed in an offset relationship so that even cutting results rather than furrows. This even cutting results since rear nozzles 162R trace a path between the paths traced by adjacent front nozzles 162F rather than tracing the same path a second time.

Second excavation head 26B has air shuttle valve 170. Air shuttle valve 170 is typically a solenoid pilot operated spool three-way valve. Air supply hose 24 supplies high pressure air to air shuttle valve 170. Air shuttle valve 170 supplies high pressure air to front nozzle bank 142F and alternately supplies high pressure air to rear nozzle bank 142R. When air shuttle valve 170 supplies high pressure air to a nozzle bank, it does not supply high pressure air to the other nozzle bank. Thus a high pressure air supply cycle is provided in which high pressure air is supplied to front nozzle bank 142F while no high pressure air is supplied to rear nozzle bank 142R. Next, the air supply cycle continues with high pressure air supplied to rear nozzle bank 142R while no high pressure air is supplied to front nozzle bank 142F.

In second excavation head 26B, high pressure air is supplied in sufficient quantity to fully develop the desired flow in all of nozzles 162F of front nozzle bank 142F. Then, at a prescribed interval, air shuttle valve 170 switches high pressure air from front nozzle bank 142F to rear nozzle bank 142R. Switching time between intervals is preferably small compared to the time of action of each nozzle bank. High pressure air flows through front nozzle bank 142F for tenths of a second. Then air shuttle valve 170 switches high pressure air from front nozzle bank 142F to rear nozzle bank 142R using a switching time that is typically on the order of milliseconds. Next, high pressure air flows through rear nozzle bank 142 for several tenths of a second. Finally, the cycle is completed when air shuttle valve 170 switches high pressure air from rear nozzle bank 142R. Accordingly, a particular nozzle bank has high pressure air flowing through it two to three times per second. The nozzle bank switching process described in this paragraph results in loosened soil 60 tending to be "launched" into the air within soil removal cavity 150 as the soil bursts and effervesces from the cutting action of the high speed air.

Figure 11:
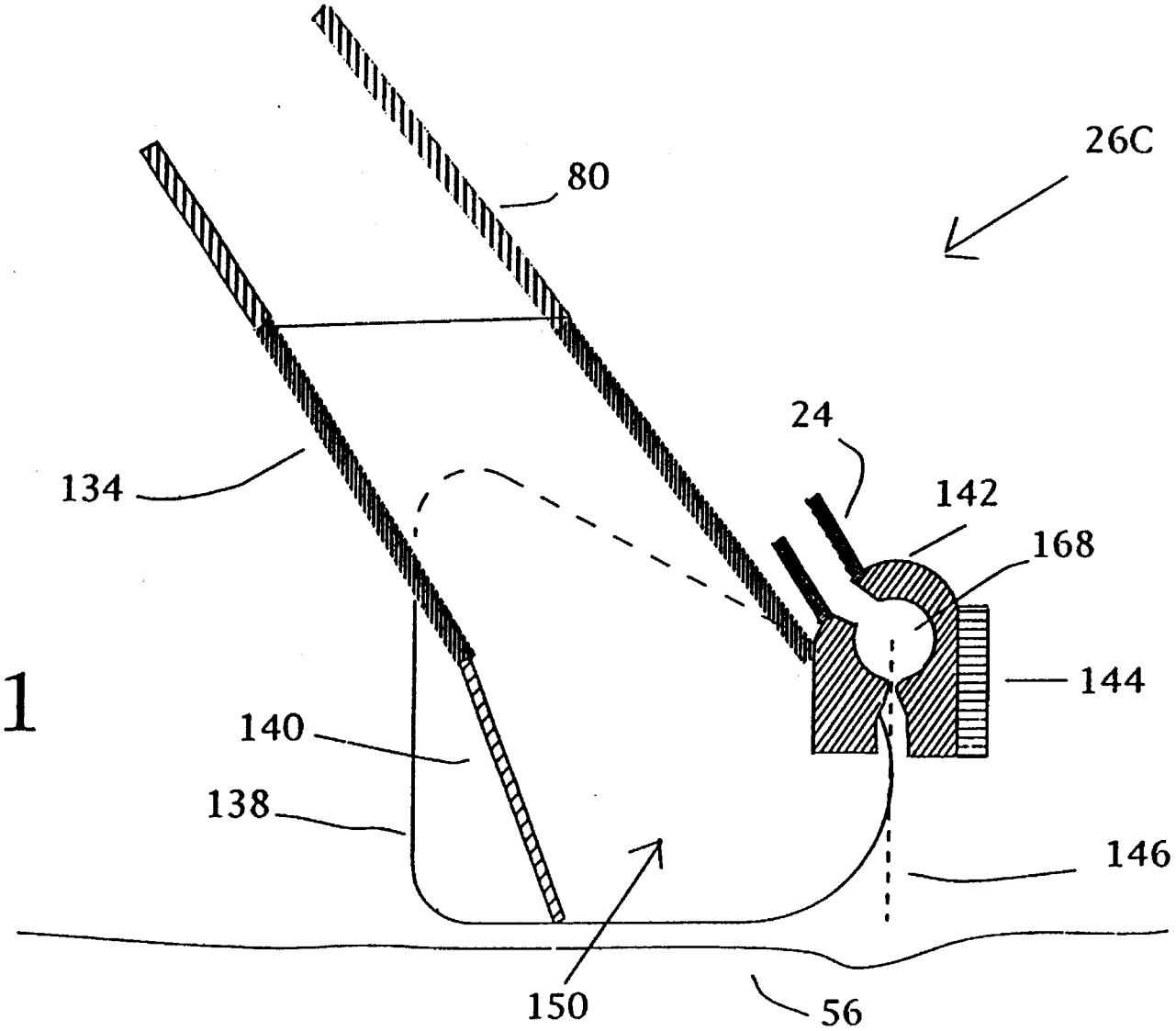
FIG. 11 is a side elevation view in section showing a third embodiment of an excavation head of the present invention.

FIG. 11 shows excavation head 26C which is an alternate embodiment of the single nozzle bank embodiment of excavation head 26 shown in FIGS. 7, 8, 9 and 10. Excavation head 26C has an angle between excavation face 56 and vacuum transport pipe 134 that is steeper (approximately forty degrees) than the corresponding angles of embodiments earlier described herein. This steeper angle results from orienting vacuum transport pipe 134 closer to perpendicular to excavation face 56 than in other embodiments herein described. In excavation head 26C, skirt seal 140 is similarly at a steeper angle with respect to excavation face 56 (approximately seventy degrees) than its counterpart in excavation head 26 (approximately thirty degrees). Left skirt 136 (not shown) and right skirt 138 of excavation head 26C are right triangles having their right angles located at the lower rear of excavation head 26C.

The lengths, distances and angles disclosed herein are representative. Persons skilled in the art of the present invention may, upon exposure to the teachings herein, conceive other variations. Such variations are deemed to be encompassed by the disclosure, the invention being limited only by appended claims.

We claim:

1. An apparatus for pneumatically excavating soil from an excavation face comprising a movable support structure, a vessel mounted on the support structure defining an internal chamber, a boom member carried by the support structure and having first and second end portions and a longitudinal axis and having a passageway extending between the first and second end portions, means for connecting the first end portion to the vessel so that the passageway in the boom member is in communication with the internal chamber of the vessel which includes a sphere secured to the first end portion of the boom member and a retainer carried by the vessel having a cavity for cooperatively receiving the sphere so that the first end portion of the boom member is pivotably connected to the vessel, the sphere being provided with a slot extending in a plane that contains the longitudinal axis of the boom member and a pin being carried by the retainer and having a portion which extends into the slot along a radius of the sphere for restricting rotation of the boom member about its longitudinal axis, means carried by the second end portion of the boom member for dislodging soil from the excavation face when the second end portion of the boom member is placed in the vicinity of the excavation face and means carried by the support structure and connected to the vessel for creating a negative pressure within the internal chamber of the vessel and the passageway of the boom member for lifting the dislodged soil from the excavation face into the second end portion of the boom member and for carrying the dislodged soil through the passageway and into the internal chamber.

2. An apparatus as in claim 1 wherein the boom member includes an internal surface for forming the passageway of the boom member, the internal surface being smooth so as to facilitate travel of the dislodged soil through the boom member.

3. An apparatus as in claim 2 wherein the boom member is rigid.

4. An apparatus as in claim 2 wherein the boom member is free of bends so as to inhibit clogging of the dislodged soil passing therethrough.

5. An apparatus as in claim 1 wherein the boom member has an extensible portion.

6. An apparatus as in claim 5 wherein the boom member includes a first portion and a second portion which telescopes with respect to the first portion.

7. An apparatus as in claim 1 wherein the movable support structure comprises a wheeled support structure.

8. An apparatus as in claim 1 wherein the means carried by the support structure and connected to the vessel for creating a negative pressure is separate from the compressor means.

9. An apparatus as in claim 8 wherein the compressor means delivers air having a pressure in excess of 10 psig.

10. An apparatus as in claim 9 wherein the compressor means delivers air in excess of 13 psig to create supersonic jets of air at the plurality of nozzles for dislodging soil from the surface of the earth.

11. An apparatus as in claim 1 wherein the means for connecting the first end portion of the boom member to the vessel includes means for cooperatively coupling the sphere to the retainer to permit the second end portion of the boom member to move from side to side relative to the first end portion of the boom member.

12. An apparatus as in claim 11 wherein the means for connecting the first end portion of the boom member to the vessel includes means for cooperatively coupling the sphere to the retainer to permit the second end portion of the boom member to move upwardly and downwardly relative to the first end portion of the boom member.

13. An apparatus for pneumatically excavating soil from an excavation face comprising a movable support structure, a vessel mounted on the support structure defining an internal chamber, a boom member carried by the support structure and having first and second end portions and a passageway extending between the first and second end portions, means for connecting the first end portion to the vessel so that the passageway in the boom member is in communication with the internal chamber of the vessel which includes a sphere secured to the first end portion of the boom member and a retainer carried by the vessel having a cavity for cooperatively receiving the sphere so that the first end portion of the boom member is pivotably connected to the vessel and the second end portion of the boom member can move from side to side and upwardly and downwardly relative to the first end portion of the boom member, a plurality of nozzles carried by the second end portion of the boom member, compressor means carried by the support structure and in communication with the plurality of nozzles for delivering pressurized air to the plurality of nozzles to create jets of air for dislodging soil from the excavation face when the second end portion of the boom member is placed in the vicinity of the excavation face, means carried by the support structure and connected to the vessel for creating a negative pressure within the internal chamber of the vessel and the passageway of the boom member for lifting the dislodged soil from the excavation face into the second end portion of the boom member and for carrying the dislodged soil through the passageway and into the internal chamber and means for continuously removing the dislodged soil from the internal chamber of the vessel during operation of the apparatus whereby the continuous removal of the dislodged soil from the internal chamber permits the vessel to have a minimal size and permits continuous operation of the apparatus free of interruptions for emptying the vessel, the boom member having a longitudinal axis and the means for connecting the first end portion of the boom member to the vessel including means for restricting rotation of the boom member about its longitudinal axis which includes a slot provided in the sphere extending in a plane that contains the longitudinal axis of the boom member and a pin carried by the retainer and having a portion which extends into the slot along a radius of the sphere.

14. An apparatus as in claim 13 wherein said means for creating a negative pressure includes a vacuum pump.

15. An apparatus as in claim 4 further comprising a filter interposed between the vessel and the vacuum pump such that the filter permits air to pass from the internal chamber of the vessel to the vacuum pump but does not permit dislodged soil to pass from the internal chamber to the vacuum pump.

16. An apparatus as in claim 14 further comprising an additional vessel having an internal chamber, means for connecting the additional vessel to the first-named vessel and the vacuum pump so that the additional vessel receives a portion of the dislodged soil in the first named vessel and means carried by the additional vessel for continuously removing the portion of the dislodged soil from the internal chamber of the additional vessel whereby the vacuum pump draws the portion of the dislodged soil from the internal chamber of the first named vessel into the internal chamber of the additional vessel and the means carried by the additional vessel for continuously removing the portion of the dislodged soil then expels that portion of the dislodged soil from the additional vessel.

17. An apparatus as in claim 16 wherein the means for connecting the additional vessel to the first-named vessel and the vacuum pump includes offset inlet openings in the additional vessel which create a cyclone action in the additional vessel for facilitating separation of the dislodged soil therein.

18. An apparatus as in claim 16 further comprising a filter interposed between the additional vessel and the vacuum pump such that the filter permits air to pass from the internal chamber of the additional vessel to the vacuum pump but the filter does not permit dislodged soil to pass from the internal chamber of the additional vessel to the vacuum pump.

19. An apparatus as in claim 13 further comprising an endless conveyor carried by the support structure for receiving dislodged soil from the internal chamber of the vessel and discharging the dislodged soil at a soil discharge location.

20. An apparatus as in claim 19 further comprising a chute carried by the support structure for receiving the dislodged soil discharged by the conveyor so that the dislodged soil passes from the conveyor to the soil discharge location by way of the chute.

21. An apparatus as in claim 19 wherein the conveyor has first and second portions and means for connecting the first and second portions so that the first portion pivots relative to the second portion.

22. An apparatus as in claim 13 further comprising means carried by the movable structure for receiving dislodged soil from the internal chamber of the vessel and for continuously discharging the dislodged soil from the movable structure.

23. An apparatus as in claim 13 further comprising a plurality of additional nozzles spaced apart from the plurality of first named nozzles, means carried by the support structure for alternating the delivery of pressurized air between the plurality of first named nozzles and the plurality of additional nozzles so as to create spaced apart alternating jets of air for acting on the excavation face whereby the alternating jets of air facilitate lifting of the dislodged soil into the second end portion of the boom member.

* * * * *